US010435984B2

(12) United States Patent
Mericas et al.

(10) Patent No.: US 10,435,984 B2
(45) Date of Patent: Oct. 8, 2019

(54) FLOAT VALVE WITH RESETTABLE AUTO-FILL

(71) Applicant: Halliburton Energy Services, Inc., Houston, TX (US)

(72) Inventors: Christopher J. Mericas, Houston, TX (US); Nicholas F. Budler, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 15/325,384

(22) PCT Filed: Aug. 12, 2014

(86) PCT No.: PCT/US2014/050619
§ 371 (c)(1),
(2) Date: Jan. 10, 2017

(87) PCT Pub. No.: WO2016/024948
PCT Pub. Date: Feb. 18, 2016

(65) Prior Publication Data
US 2017/0167225 A1 Jun. 15, 2017

(51) Int. Cl.
*E21B 21/10* (2006.01)
*E21B 33/14* (2006.01)
(Continued)

(52) U.S. Cl.
CPC ..... *E21B 34/08* (2013.01); *E21B 21/10* (2013.01); *E21B 23/006* (2013.01); *E21B 33/14* (2013.01)

(58) Field of Classification Search
CPC ..... E21B 33/14; E21B 21/10
See application file for complete search history.

(56) References Cited

U.S. PATENT DOCUMENTS 3,819,282 A 6/1974 Schultz
4,067,358 A * 1/1978 Streich ..... E21B 21/10 137/515

(Continued)

FOREIGN PATENT DOCUMENTS

EP 0533369 3/1993

OTHER PUBLICATIONS

International Search Report and Written Opinion of PCT Application No. PCT/US2014/050619 dated May 12, 2015: pp. 1-15.

*Primary Examiner* — David J Bagnell
*Assistant Examiner* — Theodore N Yao
(74) *Attorney, Agent, or Firm* — Chamberlain Hrdlicka

(57) ABSTRACT

A float valve can include a selection mechanism having an open configuration in which flow into and out of the valve is permitted, and a closed configuration in which flow out of the valve is permitted and flow into the valve is prevented. The selection mechanism can be actuated from the closed configuration to the open configuration. A method of actuating a float valve can include actuating the valve from a closed configuration in which flow into the valve is prevented but flow out of the valve is permitted, to an open configuration in which flow into and out of the valve is permitted. The valve can actuate from the open configuration to the closed configuration, and from the closed to the open configuration, in response to a flow rate through the valve being greater than a predetermined level.

17 Claims, 6 Drawing Sheets

(51) Int. Cl.
*E21B 23/00* (2006.01)
*E21B 34/08* (2006.01)

(56) References Cited

U.S. PATENT DOCUMENTS

| | | | | |
|---|---|---|---|---|
| 4,625,762 | A | 12/1986 | Hassanzadeh et al. | |
| 4,683,955 | A | 8/1987 | Stepp et al. | |
| 5,411,049 | A | 5/1995 | Colvard | |
| 5,850,881 | A | 12/1998 | Rodger et al. | |
| 2003/0098163 | A1 | 5/2003 | Hebert et al. | |
| 2007/0181188 | A1* | 8/2007 | Branch | E21B 21/10 137/494 |
| 2009/0166044 | A1* | 7/2009 | Branch | E21B 21/10 166/374 |

* cited by examiner

FLOAT VALVE WITH RESETTABLE AUTO-FILL

TECHNICAL FIELD

This disclosure relates generally to equipment utilized and operations performed in conjunction with a subterranean well and, in one example described below, more particularly provides a float valve with a resettable auto-fill feature.

BACKGROUND

A typical float valve can permit cement to be flowed out of a casing string and into an annulus formed between the casing string and a wellbore. The float valve prevents the cement from flowing back into the casing string. While the casing string is being installed in the wellbore, some float valves have an auto-fill feature that allows fluid in the wellbore to flow through the valve into the casing string, so that the casing string does not have to be filled from surface as it is installed.

Thus, it will be readily appreciated that improvements are continually needed in the art of constructing and operating float valves. Such improved float valves may be used in cementing and other operations in wells.

DETAILED DESCRIPTION

Figure 1:
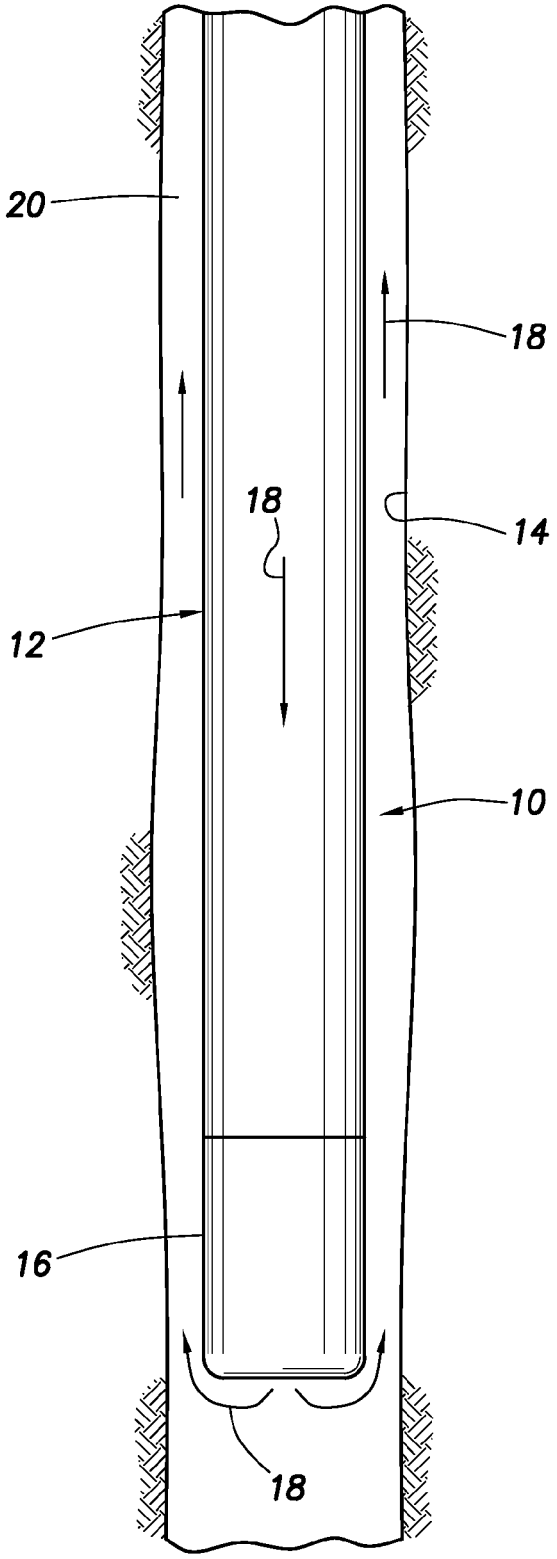
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a casing string 12 is being installed and cemented in a wellbore 14. As used herein, the terms "casing," "casing string," and the like, refer to a generally tubular protective wellbore lining. Casing may be of the types known to those skilled in the art as casing, liner or tubing. Casing may be made of metal or other materials, and may be continuous or segmented.

As used herein, the terms "cement," "cementing," and the like, refer to a hardenable material that is flowed into an annulus between a casing string and a wellbore (or another casing string) and hardens in the annulus. When hardened, the cement secures the casing string in the wellbore and can perform other functions, such as, preventing flow through the annulus between zones penetrated by the wellbore, preventing undesired leakage into or out of the casing string, etc.

Cement is not necessarily a cementitious material. For example, epoxies or other hardenable polymer materials may be used for cementing. However, it should be clearly understood that the scope of this disclosure is not limited to use with a cementing operation, or any other particular operation, in a well.

As depicted in FIG. 1, the casing string 12 includes a float valve 16. The float valve 16 is connected at a lower distal end of the casing string 12 in this example, but in other examples the float valve could be connected at another position in the casing string.

The float valve 16 permits flow of fluid 18 longitudinally through the casing string 12, and out of the casing string into the wellbore 14 via the valve. While the casing string 12 is being installed, the fluid 18 may be circulated through the casing string and an annulus 20 formed between the casing string and the wellbore 14 for various purposes (for example, to wash the casing string past an obstruction, to treat the wellbore with a fluid loss control agent, to prevent sticking, to maintain a desired fluid density in the wellbore, etc.).

After the casing string 12 has been appropriately positioned in the wellbore 14, the fluid 18 can comprise cement, spacers, gels and/or other materials. In general, in a cementing operation, it is desired to place the cement in the annulus 20, and to allow the cement to harden in the annulus, thereby securing the casing string 12 in the wellbore 14.

The fluid 18 can also flow in a reverse direction from that depicted in FIG. 1. For example, while the casing string 12 is being installed, the fluid in the wellbore 14 can flow into the casing string via the float valve 16. This feature is known to those skilled in the art as an "auto-fill" feature, because it allows a casing string to automatically fill with fluid as it is installed in a wellbore.

However, in a typical float valve construction, the auto-fill feature can only be used once. After the auto-fill feature is disabled, fluid can only exit the casing string—fluid can no longer enter the casing string via the valve. In contrast, the float valve 16 of FIG. 1 includes a resettable auto-fill feature, so that the auto-fill feature can be enabled multiple times.

Note that the float valve 16 also includes a variety of other features, described more fully below. It should be clearly understood that the scope of this disclosure is not limited to any particular feature or combination of features in the float valve 16 described herein or depicted in the drawings.

Figure 2:
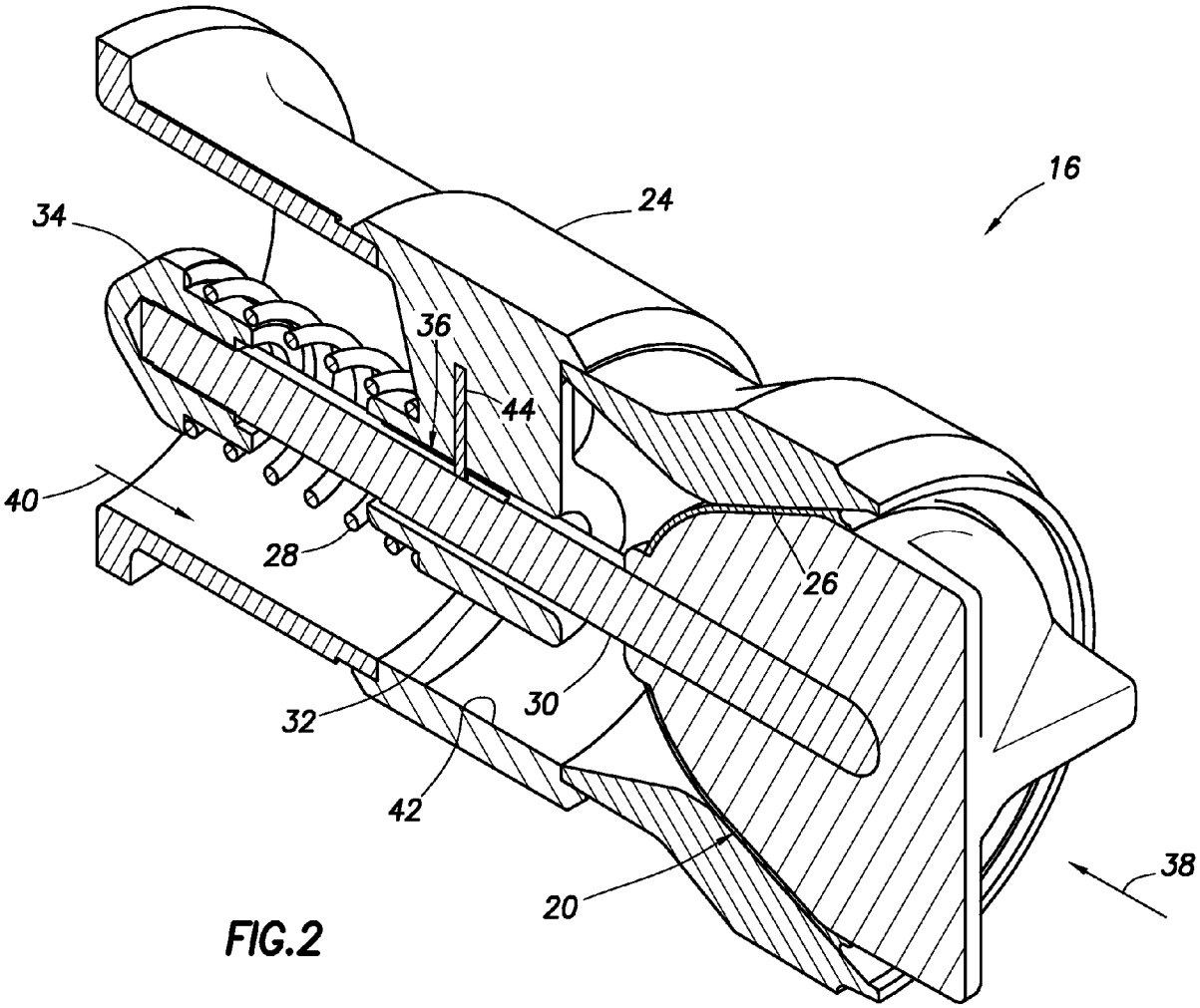
FIG. 2 is a representative enlarged scale cross-sectional view of a float valve that can be used in the system and method of FIG. 1, and which can embody the principles of this disclosure.

Referring additionally now to FIG. 2, an enlarged scale cross-sectional view of the float valve 16 is representatively illustrated. The float valve 16 of FIG. 2 may be used in the system and method of FIG. 1, or it may be used in other systems and methods in keeping with the principles of this disclosure.

Only certain components of the float valve 16 are depicted in FIG. 2. In practice, an assembly depicted in FIG. 2 may be received in an outer housing (not shown) configured for connection in the casing string 12 (see FIG. 1). For example, a cement or other relatively easily drillable material (not shown) may be used to secure the FIG. 2 assembly in an outer housing.

The various components of the FIG. 2 assembly may be made of relatively easily drilled materials (such as, aluminum, brass, elastomers, other polymers, etc.). In this manner, the float valve 16 can be drilled through, if desired, after the casing string 12 (see FIG. 1) has been cemented.

In the FIG. 2 example, the float valve 16 includes a closure device 20 reciprocably received in an inner housing assembly 24. A generally conical seat 26 is formed in one end of the inner housing assembly 24.

The closure device 20 is biased toward the seat 26 by a biasing device 28, depicted as a coiled spring in FIG. 2. A stem 30 of the closure device 20 extends through an inner support 32 and through the biasing device 28. A retainer 34 on the stem 30 is configured to allow the biasing device 28 to be compressed between the support 32 and the retainer.

A selection mechanism 36 is used to control displacement of the closure device 20 relative to the housing assembly 24 and its seat 26. In the FIG. 2 closed configuration, the selection mechanism 36 allows the biasing device 28 to displace the closure device 20 into sealing engagement with the seat 26, thereby preventing flow into the valve 16 (e.g., in a longitudinal direction 38).

However, in the closed configuration, longitudinal flow out of the valve 16 (e.g., in a longitudinal direction 40) is permitted, since the biasing device 28 can be compressed to allow the closure device 20 to disengage from the seat 26. Thus, flow through a longitudinal passage 42 of the valve 16 is permitted in one direction 40, but is prevented in an opposite direction 38.

The valve 16 can be actuated to the FIG. 2 closed configuration, for example, during the cementing operation described above, in order to prevent reverse flow of cement into the casing string 12 (see FIG. 1). This ensures that cement placed in the annulus 20 (see FIG. 1) will remain in position while it hardens.

The selection mechanism 36 in the FIG. 2 example includes a pin, lug, protrusion or other engagement member 44 and a profile 46. The engagement member 44 extends inwardly from the support 32 into engagement with the profile 46 formed on the stem 30, as depicted in FIG. 2, but in other examples these positions could be reversed. Indeed, other types of selection mechanisms could be used, and so the scope of this disclosure is not limited at all to any of the specific details of the selection mechanism 36 or other components of the valve 16 described herein or depicted in the drawings.

The selection mechanism 36 allows the valve 16 to be actuated to an open configuration (see FIG. 6), in which flow into and out of the valve (e.g., in both longitudinal directions 38, 40) is permitted. In the open configuration, the selection mechanism 36 maintains the closure device 20 spaced apart from the seat 26, preventing the biasing device 28 from displacing the closure device into sealing engagement with the seat.

Figure 3:
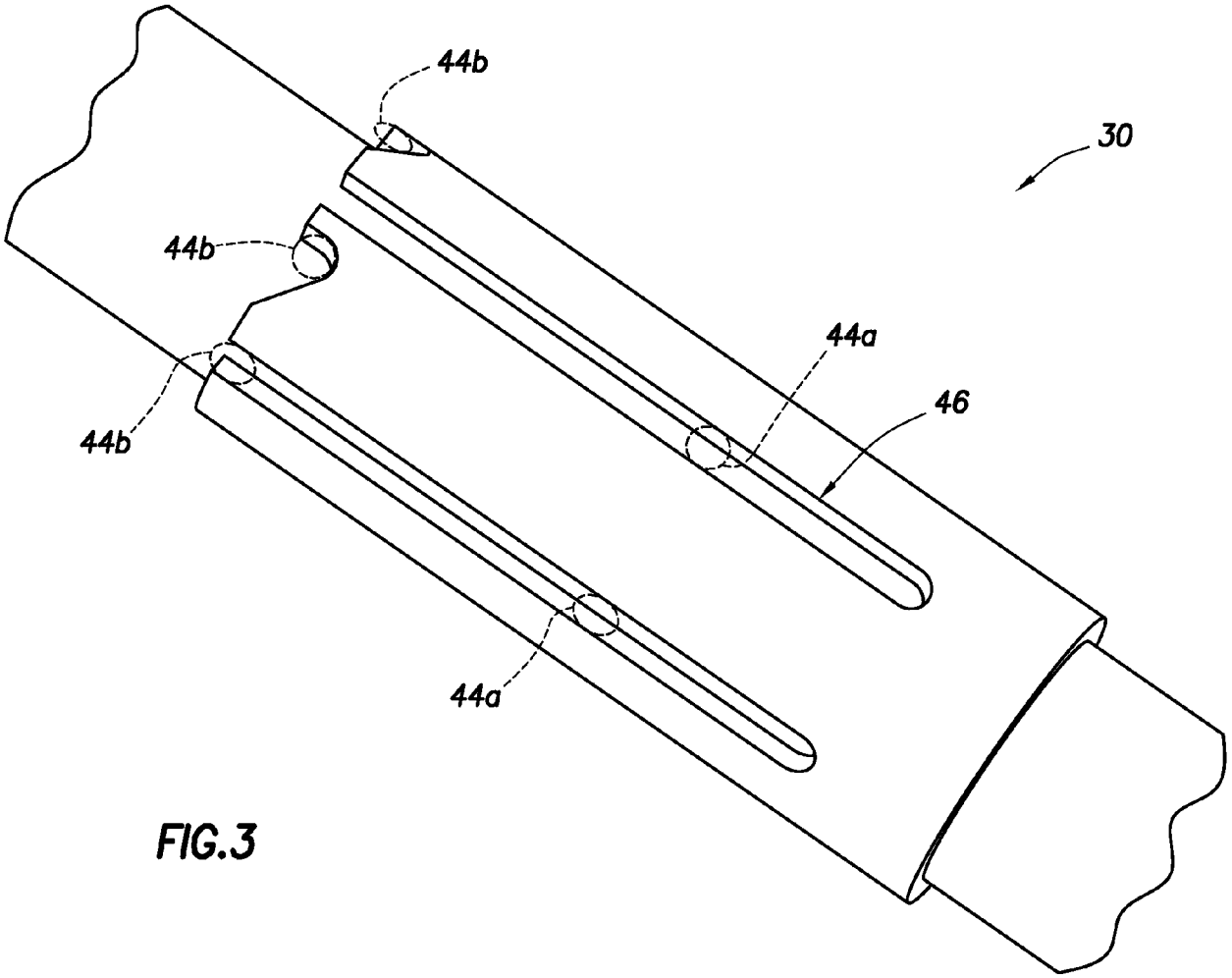
FIG. 3 is a representative further enlarged scale perspective view of a stem of the float valve.

Referring additionally now to FIG. 3, a further enlarged scale perspective view of the stem 30 is representatively illustrated, apart from the remainder of the valve 16. In this view, the profile 46 formed on the stem 30 can be more clearly seen.

Although the profile 46 depicted in FIG. 3 includes multiple separate circumferentially spaced sections, in some examples the profile can be continuous, as with the type of profile known to those skilled in the art as a "J-slot" profile. In other examples, the profile 46 could be configured similar to the type of profile found in a conventional push-button retractable writing pen (see, for example, U.S. Pat. No. 3,819,282). Thus, the scope of this disclosure is not limited to use of any particular type of profile in the selection mechanism 36.

The profile 46 provides for a first position 44*a* of the engagement member (see FIG. 2) relative to the profile, and a second position 44*b* of the engagement member relative to the profile. When the engagement member 44 is at the first position 44*a*, the biasing device 28 can displace the closure device 20 into sealing engagement with the seat 26, and the valve 16 is in the closed configuration of FIG. 2. When the engagement member 44 is at the second position 44*b*, the selection mechanism 36 prevents the biasing device 28 from displacing the closure device 20 into sealing engagement with the seat 26, and the valve 16 is in the open configuration of FIG. 6.

The profile 46 example of FIG. 3 provides for multiple closed positions 44*a* and multiple open positions 44*b*. In this manner, the valve 16 can be actuated to its closed and open configurations multiple times, as described more fully below.

To longitudinally displace the stem 30, so that the engagement member 44 can engage the profile 46 at the different positions 44*a,b*, fluid flow through the passage 42 (see FIG. 2) is selectively increased and decreased, as described more fully below. To rotate the stem 30, so that the engagement member 44 can engage the profile 46 at the different positions 44*a,b*, the biasing device 28 or another device (such as, a torsion spring, a second set of engagement members and profiles as in a retractable pen mechanism, an inclined portion of a J-slot profile, etc.) can be used.

Figure 4:
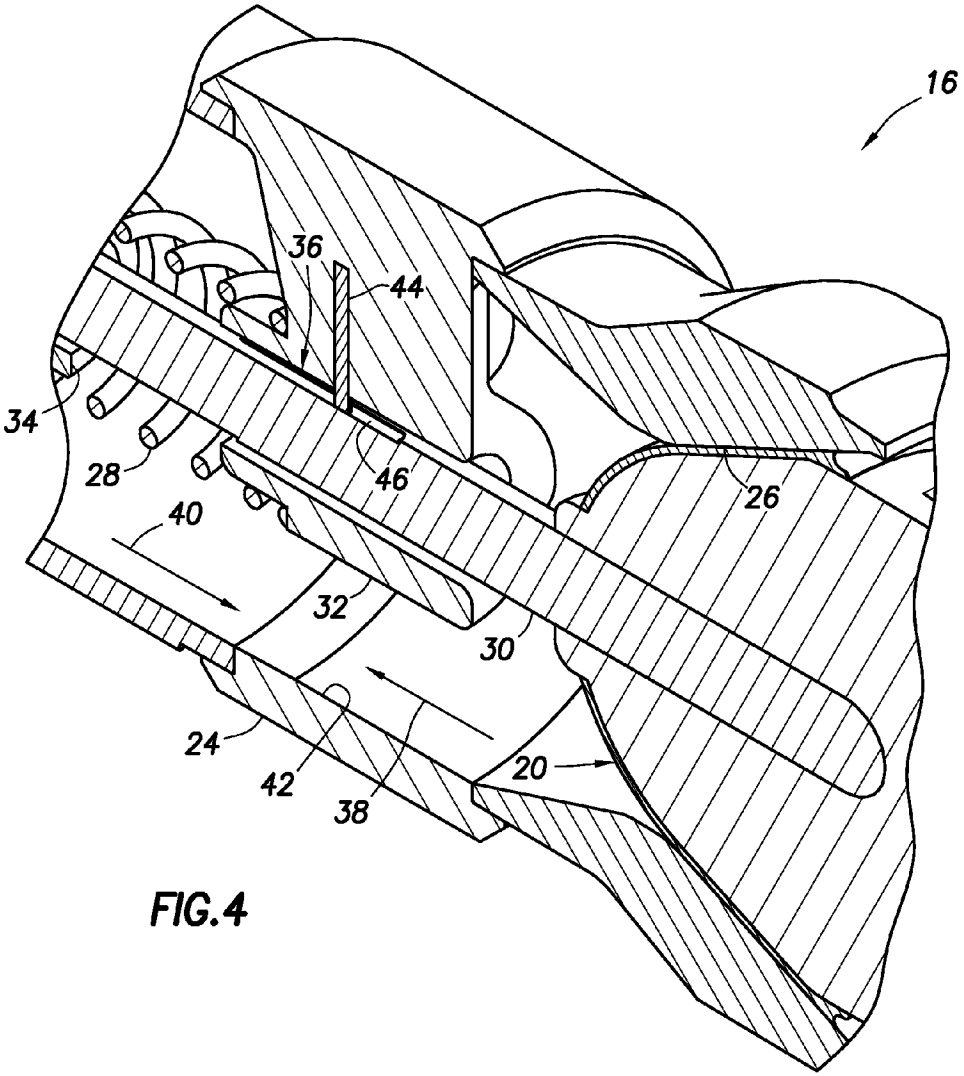
FIG. 4 is a representative cross-sectional view of the float valve in a closed configuration.
Figure 5:
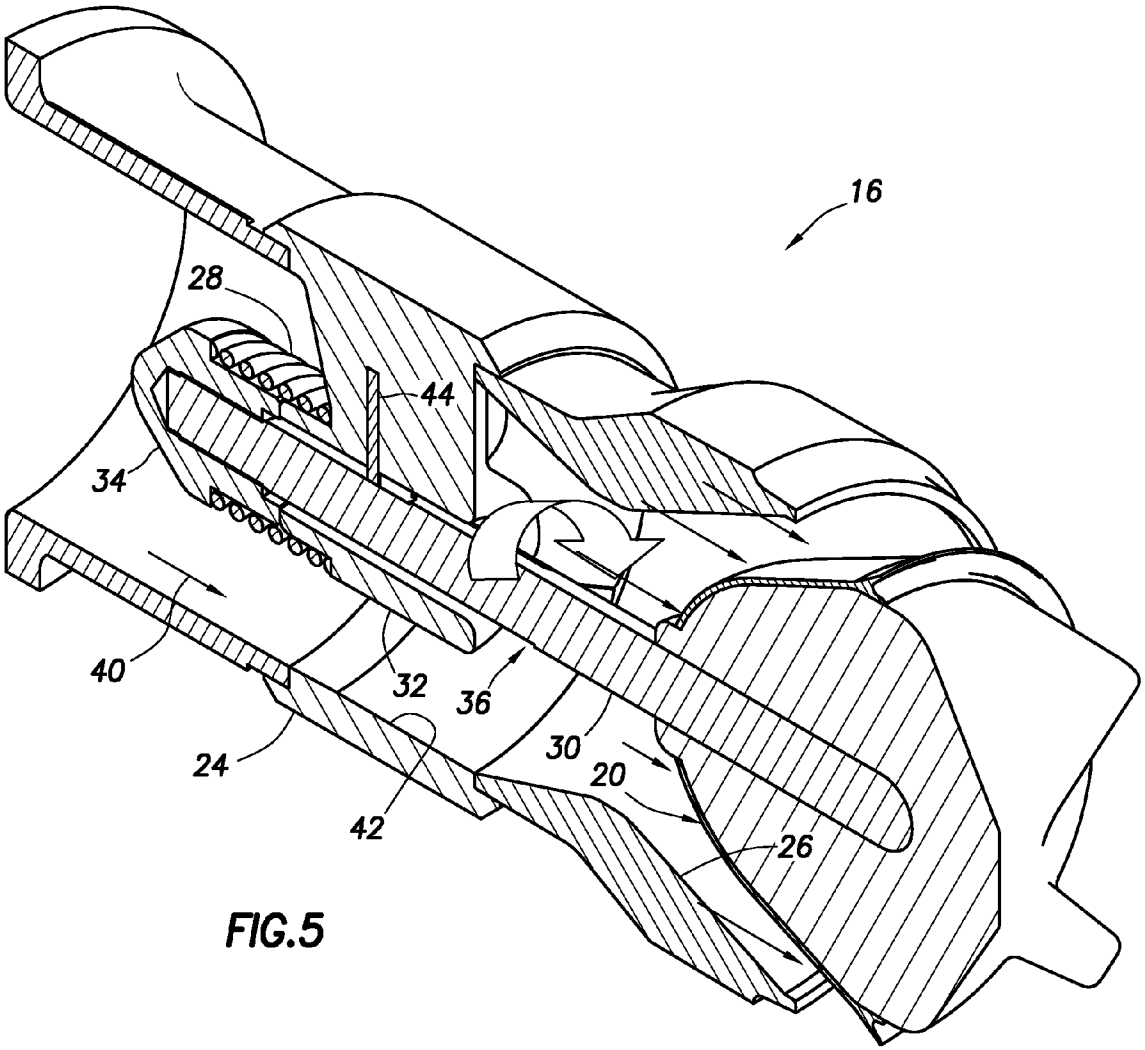
FIG. 5 is a representative cross-sectional view of the float valve during flow rate actuation thereof.
Figure 6:
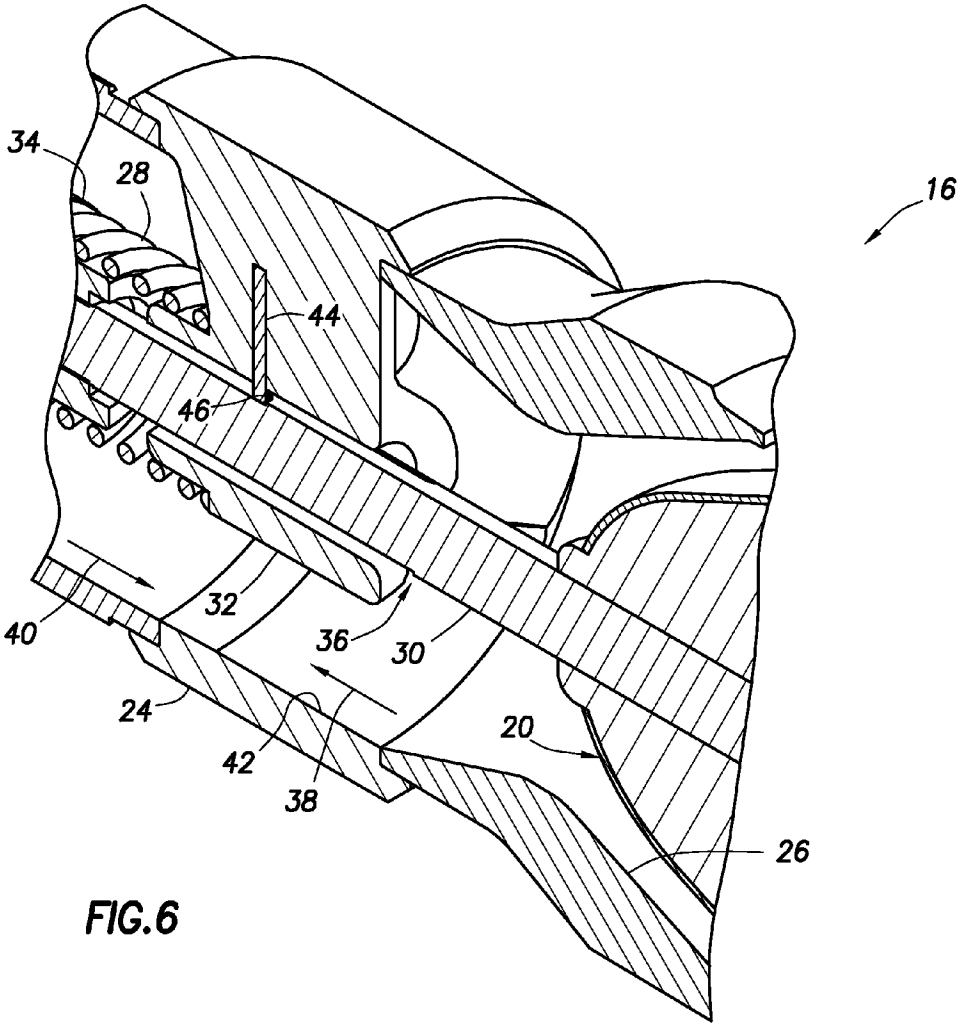
FIG. 6 is a representative cross-sectional view of the float valve in an open configuration.

Referring additionally now to FIGS. 4-6, cross-sectional views of the valve 16 being actuated between the closed and open configurations are representatively illustrated. FIGS. 4-6 depict the valve 16 being actuated from the closed configuration to the open configuration, but it should be clearly understood that the valve can also be actuated from the open configuration to the closed configuration. In some examples, these actuations can be repeated multiple times (e.g., by providing multiple positions 44*a,b*), and in some examples these actuations can be repeated indefinitely.

In FIG. 4, the valve 16 is in the closed configuration. The closure device 20 is sealingly engaged with the seat 26. The engagement member 44 is at the first position 44*a* (see FIG. 3) in the profile 46. Flow into the passage 42 (e.g., in the direction 38) is prevented. Flow out of the passage 42 (e.g., in the direction 40) is permitted.

In FIG. 5, flow in the direction 40 is increased to at least a predetermined flow rate level. This level can be adjusted, for example, by adjusting a biasing force exerted by the biasing device 28. The flow causes the closure device 20 to displace longitudinally, compressing the biasing device 28, and causing the stem 30 to rotate, so that the engagement member 44 is aligned with a next section of the profile 46 (see FIG. 3).

In FIG. 6, the valve 16 is in the open configuration. The closure device 20 is spaced apart from the seat 26. The engagement member 44 is at the second position 44*b* (see FIG. 3) in the profile 46. Flow into and out of the passage 42 (e.g., in the directions 38, 40) is permitted.

The valve 16 can be returned to the open configuration of FIG. 4 by again increasing flow in the direction 40 to at least the predetermined flow rate level. The flow causes the closure device 20 to displace longitudinally, compressing the biasing device 28, and causing the stem 30 to rotate, so that the engagement member 44 is aligned with a next section of the profile 46 (see FIG. 3) corresponding to the open configuration.

The above steps can be repeated as many times as the chosen configuration/number of profile 46 sections and engagement member(s) 44 allows, or indefinitely in some examples. Thus, the valve 16 can be actuated to the open configuration from the closed configuration, and can be actuated to the closed configuration from the open configuration, allowing the auto-fill feature to be reset downhole, if desired.

One feature of the selection mechanism 36 configuration described above is that it provides for convenient assembly of the valve 16. For example, the stem 30 can be inserted through the inner support 32, thereby engaging the engagement member 44 with the profile 46, prior to installing the biasing device 28. There is no need to compress the biasing device 28 while the selection mechanism 36 is assembled. However, as mentioned above, different types of selection mechanisms may be used in other examples.

It may now be fully appreciated that the above disclosure provides significant advancements to the art of constructing and operating float valves. A float valve 16 example described above and depicted in the drawings has a resettable auto-fill feature, enabling the valve to be actuated back and forth between open and closed configurations.

In particular, the above disclosure provides to the art a float valve 16. In one example, the valve 16 can include a selection mechanism 36 having an open configuration (see FIG. 6) in which flow into and out of the valve 16 is permitted, and a closed configuration (see FIGS. 2 & 4) in which flow out of the valve 16 is permitted and flow into the valve 16 is prevented. The selection mechanism 36 can be actuated from the closed configuration to the open configuration.

The selection mechanism 36 can be actuated from the open configuration to the closed configuration in response to a flow rate through the valve 16 being greater than a first predetermined level, and the selection mechanism 36 can be actuated from the closed configuration to the open configuration in response to the flow rate through the valve 16 being greater than a second predetermined level. The first and second predetermined levels may be substantially equal.

The selection mechanism 36 can comprise an engagement member 44 engaged with a profile 46, the selection mechanism 36 being in the closed configuration when the engagement member 44 is engaged with the profile at a first position 44*a*, and the selection mechanism 36 being in the open configuration when the engagement member 44 is engaged with the profile 46 at a second position 44*b*. The profile 46 can comprise multiple first and second positions 44*a,b*.

The float valve 16 can include a seat 26 and a closure device 20 including a stem 30. Longitudinal flow through the valve 16 is prevented when the closure device 20 is sealingly engaged with the seat 26. Longitudinal flow through the valve 16 is permitted when the closure device 20 is spaced apart from the seat 26 by the selection mechanism 36.

In this example, the selection mechanism 36 can comprise an engagement member 44 engaged with a profile 46 formed on the stem 30. The engagement member 44 may engage the profile 46 in both of the open and closed configurations of the selection mechanism 36.

The above disclosure also provides to the art a method of actuating a float valve 16. In one example, the method can comprise actuating the valve 16 from a closed configuration in which flow into the valve is prevented but flow out of the valve is permitted, to an open configuration in which flow into and out of the valve 16 is permitted.

The actuating step may be performed multiple times. The actuating step may be performed by flowing through the valve 16 at greater than a predetermined flow rate.

The method can include actuating the valve 16 from the open configuration to the closed configuration. The method can include actuating the valve 16 from the open configuration to the closed configuration multiple times.

The method can include actuating the valve 16 from the open configuration to the closed configuration by flowing through the valve at greater than a predetermined flow rate.

The actuating step can include causing relative displacement between an engagement member 44 and a profile 46 of a selection mechanism 36.

A well system 10 is also provided to the art by the above disclosure. In one example, the system 10 can include a float valve 16 connected to a casing string 12, the valve 16 having an open configuration in which flow into and out of the casing string 12 through the valve 16 is permitted, and a closed configuration in which flow out of the casing string 12 through the valve 16 is permitted and flow into the casing string 12 through the valve 16 is prevented. The valve 16 actuates from the open configuration to the closed configuration in response to a flow rate through the valve 16 being greater than a first predetermined level, and the valve 16 actuates from the closed configuration to the open configuration in response to the flow rate through the valve 16 being greater than a second predetermined level.

The first and second predetermined levels can be the same.

The valve 16 can comprise an engagement member 44 engaged with a profile 46, the valve 16 being in the closed configuration when the engagement member 44 is engaged with the profile 46 at a first position 44*a*, and the valve 16 being in the closed configuration when the engagement member 44 is engaged with the profile 46 at a second position 44*b*.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A float valve to control flow of a fluid, comprising:

a housing comprising:

a seat positioned at a downhole end of the housing; and an inner support member;

a closure device comprising a stem, wherein closure device comprises an open state in which the closure device is spaced apart from the seat and a closed state in which the closure device is sealingly engaged with the seat, and wherein a portion of the closure device remains outside the housing in both the open state and the closed state, and wherein the stem extends uphole through the inner support;

a retainer separate from and coupled to an uphole end of the stem, wherein the closure device is removable from the housing upon removal of the retainer from the stem and without disassembly of the housing;

a biasing device in engagement with the stem between the retainer and the inner support member such that the biasing device biases the stem and the closure device in an uphole direction into the closed state; and a selection mechanism comprising an engagement member engaged with a profile formed in the stem or inner support, such that the selection mechanism comprises an open configuration to position the closure device in the open state in which flow into and out of the valve is permitted when the engagement member is engaged with the profile at a first position, and a closed configuration to position the closure device in the closed state in which flow out of the valve is permitted and flow into the valve is prevented when the engagement member is engaged with the profile at a second position, and wherein the selection mechanism is actuable between the closed configuration and the open configuration in response to longitudinal movement of the stem caused by flow of the fluid against uphole profiles of the retainer and the closure device.

2. The float valve of claim 1, wherein the selection mechanism is actuable from the open configuration to the closed configuration in response to a flow rate through the valve being increased, and wherein the selection mechanism is actuable from the closed configuration to the open configuration in response to the flow rate through the valve being increased.

3. The float valve of claim 2, wherein each of the flow rate increases comprises an increase in flow out of the valve.

4. The float valve of claim 1, wherein the biasing device is configured to rotate the stem in response to longitudinal movement of the stem to actuate the selection mechanism between the closed configuration and the open configuration.

5. The float valve of claim 1, wherein the profile comprises a plurality of the first and second positions.

6. The float valve of claim 1, wherein the profile is formed on the stem.

7. The float valve of claim 1, wherein the engagement member engages the profile in both of the open and closed configurations of the selection mechanism.

8. A method of controlling flow of a fluid through a float valve, the method comprising:

flowing a fluid through a housing of the valve and against a closure device, the valve comprising:

the housing comprising a seat positioned at a downhole end of the housing; and an inner support member;

the closure device comprising a stem, wherein closure device comprises an open state in which the closure device is spaced apart from the seat and a closed state in which the closure device is sealingly engaged with the seat, and wherein a portion of the closure device remains outside the housing in both the open state and the closed state, and wherein the stem extends uphole through the inner support;

a retainer separate from and coupled to an uphole end of the stem, wherein the closure device is removable from the housing upon removal of the retainer from the stem and without disassembly of the housing;

a biasing device in engagement with the stem between the retainer and the inner support member such that the biasing device biases the stem and the closure device in an uphole direction into the closed state; and a selection mechanism comprising an engagement member engaged with a profile formed in the stem or inner support, such that the selection mechanism comprises an open configuration to position the closure device in the open state in which flow into and out of the valve is permitted when the engagement member is engaged with the profile at a first position, and a closed configuration to position the closure device in the closed state in which flow out of the valve is permitted and flow into the valve is prevented when the engagement member is engaged with the profile at a second position; and actuating the selection mechanism between the closed configuration and the open configuration in response to longitudinal movement of the stem caused by flow of the fluid against uphole profiles of the retainer and the closure device.

9. The method of claim 8, wherein the actuating is performed multiple times.

10. The method of claim 8, wherein the actuating is performed by flowing through the valve at greater than a predetermined flow rate.

11. The method of claim 8, further comprising actuating the valve between the open configuration and the closed configuration multiple times.

12. The method of claim 8, further comprising actuating the valve between the open configuration and the closed configuration by flowing through the valve at greater than a predetermined flow rate.

13. The method of claim 8, wherein the actuating comprises causing relative displacement between the engagement member and the profile of the selection mechanism.

14. A well system, comprising:

a float valve connected to a casing string in a well, the valve comprising: a housing comprising:

a seat positioned at a downhole end of the housing; and an inner support member;

a closure device comprising a stem, wherein closure device comprises an open state in which the closure device is spaced apart from the seat and a closed state in which the closure device is sealingly engaged with the seat, and wherein a portion of the closure device remains outside the housing in both the open state and the closed state, and wherein the stem extends uphole through the inner support;

a retainer separate from and coupled to an uphole end of the stem, wherein the closure device is removable from the housing upon removal of the retainer from the stem and without disassembly of the housing;

a biasing device in engagement with the stem between the retainer and the inner support member such that the biasing device biases the stem and the closure device in an uphole direction into the closed state; and a selection mechanism comprising an engagement member engaged with a profile formed in the stem or inner support, such that the selection mechanism comprises an open configuration to position the closure device in the open state in which flow into and out of the valve is permitted when the engagement member is engaged with the profile at a first position, and a closed configuration to position the closure device in the closed state in which flow out of the valve is permitted and flow into the valve is prevented when the engagement member is engaged with the profile at a second position; and wherein the selection mechanism is actuable between the open configuration and the closed configuration in response to a flow rate of fluid flowing against uphole profiles of the retainer and the closure device being increased above a threshold.

15. The well cementing system of claim 14, wherein the profile comprises a plurality of the first and second positions.

16. The well cementing system of claim 14, wherein the valve further comprises an engagement member engaged with the profile formed on the stem.

17. The well cementing system of claim 14, wherein the engagement member engages the profile in both of the open and closed configurations of the valve.

* * * * *